US006402909B1

(12) United States Patent
Tran et al.

(10) Patent No.: US 6,402,909 B1
(45) Date of Patent: Jun. 11, 2002

(54) PLATING SYSTEM WITH SHIELDED SECONDARY ANODE FOR SEMICONDUCTOR MANUFACTURING

(75) Inventors: Minh Quoc Tran, Milpitas; Christy Mei-Chu Woo, Cupertino, both of CA (US)

(73) Assignee: Advanced Micro Devices, Inc., Sunnyvale, CA (US)

( * ) Notice: Subject to any disclaimer, the term of this patent is extended or adjusted under 35 U.S.C. 154(b) by 12 days.

(21) Appl. No.: 09/678,504

(22) Filed: Oct. 2, 2000

(51) Int. Cl.[7] ..... C25D 17/00; C25B 15/00
(52) U.S. Cl. ..... 204/224 R; 204/234; 204/DIG. 7
(58) Field of Search ..... 204/224 R, DIG. 7, 204/227, 237, 282

(56) References Cited

U.S. PATENT DOCUMENTS 6,251,238 B1 * 6/2001 Kaufman et al. ..... 204/242
6,270,647 B1 * 8/2001 Graham et al. ..... 204/224 R X

* cited by examiner

*Primary Examiner*—Donald R. Valentine
(74) *Attorney, Agent, or Firm*—Mikio Ishimaru

(57) ABSTRACT

An electroplating system is provided for semiconductor wafers which include a plating chamber having a consumable shielded secondary anode shielded by an inert anode from a semiconductor wafer connector. For a copper plating system the plating chamber has a consumable copper shielded anode shielded by an inert platinum anode from a semiconductor wafer connector.

12 Claims, 1 Drawing Sheet

PLATING SYSTEM WITH SHIELDED SECONDARY ANODE FOR SEMICONDUCTOR MANUFACTURING

CROSS-REFERENCE TO RELATED APPLICATIONS

The present application contains subject matter related to a concurrently filed U.S. Patent Application by Minh Quoc Tran and Christy Mei-Chu Woo entitled "PLATING SYSTEM WITH SECONDARY ANODE RING FOR SEMICONDUCTOR MANUFACTURING" and identified by Ser. No. 09/678,182.

The present application also contains subject matter related to a concurrently filed U.S. Patent Application by Minh Quoc Tran entitled "PLATING SYSTEM WITH REMOTE SECONDARY ANODE FOR SEMICONDUCTOR MANUFACTURING" and identified by Ser. No. 09/678,503.

TECHNICAL FIELD

The present invention relates generally to semiconductor manufacturing technology and more specifically to electroplating systems with consumable anodes.

BACKGROUND ART

In the past in the manufacture of semiconductors, there have been numerous processes which required plating at various stages to deposit various materials on semiconductor wafers. All of these systems generally required human operator monitoring or the addition of plating materials at timed intervals. Since the addition of plating material was deemed to be one which required a certain degree of expertise and experience, it was not thought to be possible to automate this type of operation without complex, and expensive, computer equipment.

As the industry has sought to make smaller and smaller semiconductor devices with finer and finer device connections, it has been found that conventional metallization techniques for making the device connections is are inadequate for future generations of products. This has resulted in the shift from materials such as aluminum (Al) to copper (Cu).

Copper is not suited for deposition using the metallization techniques used for aluminum and is better adapted for deposition by electro- or electro-less plating processes out of a solution. With the adoption of the copper interconnect, the device connection technology, there has been a great deal of effort placed into automating copper plating technology for semiconductors. This has meant the introduction of expensive equipment. This in turn has meant that much effort has been expended in trying to reduce costs.

One of the processes for depositing copper uses a consumable primary anode in the plating chamber. As the consumable primary anode is consumed, it changes the geometry and the electromotive field in the plating chamber leading to non-uniform deposition of the copper. Non-uniform deposition of the copper leads to difficulties in following planarization steps and in defective integrated circuits around the perimeter of the semiconductor wafer.

A solution for solving this problem simply and inexpensively has been long sought by and eluded those skilled in the art.

DISCLOSURE OF THE INVENTION

The present invention provides an electroplating system for semiconductor wafers which includes a plating chamber having a consumable shielded secondary anode "shielded" by an inert primary anode from a semiconductor wafer connector. The consumption of the consumable shielded secondary anode does not change the geometry or the electromotive field in the plating chamber and maintains a uniform thickness conductor core deposition which is easily planarized.

The present invention further provides a copper electroplating system for semiconductor wafers which includes a plating chamber having a consumable copper shielded secondary anode "shielded" by an inert platinum primary anode from a semiconductor wafer connector. The consumption of the consumable copper shielded secondary anode does not change the geometry or the electromotive field in the plating chamber and maintaining a uniform thickness copper deposition which is easily planarized.

The above and additional advantages of the present invention will become apparent to those skilled in the art from a reading of the following detailed description when taken in conjunction with the accompanying drawings.

BEST MODE FOR CARRYING OUT THE INVENTION

Figure 1:
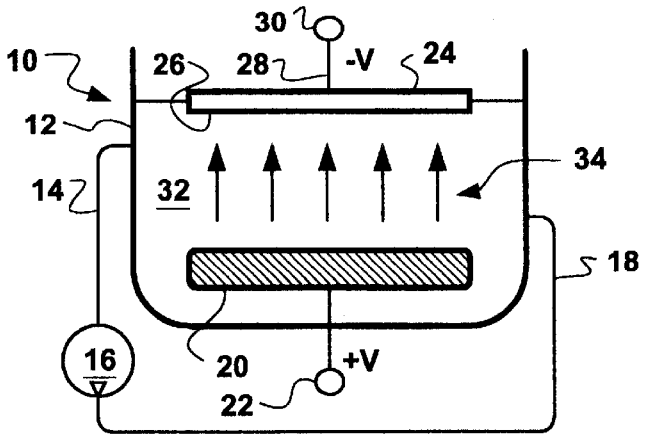
FIG. 1 (PRIOR ART)
FIG. 1 (PRIOR ART) shows a plating chamber containing a consumable primary anode.

Referring now to FIG. 1 (PRIOR ART), therein is shown an electroplating system 10 having a plating chamber 12. The plating chamber 12 has an outlet 14 connected to a recirculating pump 16 which is further connected to an inlet 18 to the plating chamber 12.

Within the plating chamber 12 is a consumable primary anode 20 connected to a positive voltage source 22.

Above the consumable primary anode 20 is a semiconductor wafer 24 having a conductive seed layer 26 thereon. The seed layer 26 is connected by a connector 28 to a negative voltage source 30 and acts as the cathode for the plating process.

The semiconductor wafer 24 is positioned so as to place the seed layer 26 in contact with a plating solution 32.

For the electroplating of copper the consumable primary anode 20 is made of copper and the plating solution 32 contains free copper ions. When the voltages are applied, copper ions are migrated from the consumable primary anode 20 to the seed layer 26 along the electromotive field indicated by straight arrows 34 through the plating solution 32. The plating solution 32 is recirculated by the recirculating pump 16 to maintain as constant a copper ion concentration as possible while the cathodic reaction at the seed layer 26 causes the deposition of metallic copper on to the seed layer 26.

Figure 2:
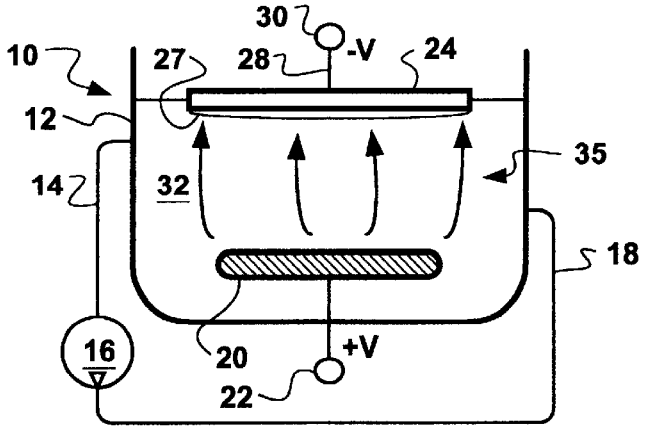
FIG. 2 (PRIOR ART)
FIG. 2 (PRIOR ART) shows a plating chamber with a portion of the consumable primary anode consumed.

Referring now to FIG. 2 (PRIOR ART), therein is shown the electroplating system 10 during the electroplating process. The consumable primary anode 20 is shown partially consumed and significantly reduced in size which changes the geometry and the electromotive field in the plating chamber 12. The shape of the electromotive field, as indicated by curved arrows 35, influences the deposition of the metal ions on the seed layer 26 of the semiconductor wafer 24.

Due to the change in the geometry and electromotive field in the plating chamber 12, the deposition of a metal 27 on the semiconductor wafer 24 will be uneven and generally concave. The metal 27 will be thickest where the distance between the consumable primary anode 20 and the semiconductor wafer 24 is the shortest and will be thinner where the consumable primary anode 20 and the semiconductor wafer 24 are further apart.

The variation in thickness of the metal 27 makes it very difficult to properly planarize the semiconductor wafer 24 by subsequent chemical-mechanical planarization processes and results in defective integrated circuits around the perimeter of the semiconductor wafer 24.

Figure 3:
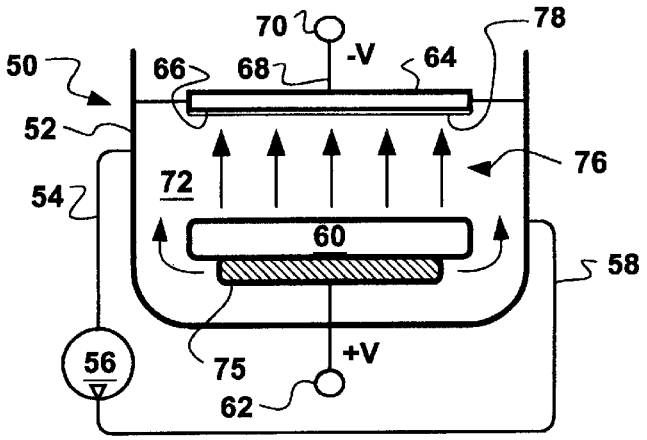
FIG. 3 shows an electroplating system having a consumable shielded secondary anode in accordance with the present invention.

Referring now to FIG. 3, therein is shown an electroplating system 50 according to the present invention. The electroplating system 50 includes a plating chamber 52 having an outlet 54 connected to a recirculating pump 56 which is further connected to an inlet 58 to the plating chamber 52.

Within the plating chamber 52 is an inert primary anode 60 connected to a positive voltage source 62. The inert primary anode 60 is of a material, which will not take part in the plating process and which is not consumed, such as platinum (Pt).

Above the inert primary anode 60 is a semiconductor wafer 64 having a conductive seed layer 66 thereon. The seed layer 66 is connected by a connector 68 to a negative voltage source 70 and acts as the cathode for the plating process.

The semiconductor wafer 64 is positioned so as to place the seed layer 66 in contact with a plating solution 72.

Under the inert primary anode 60 is a consumable shielded secondary anode 75. The consumable shielded secondary anode 75 is connected to the positive voltage source 62 and the inert primary anode 60 may be directly connected to the consumable shielded secondary anode 75.

The consumable shielded secondary anode 75 is placed so that, as it is consumed, the geometry and electromotive field in the plating chamber 52 do not change so the electromotive field for metal ions plated on the seed layer 66 is always the same and directly between the inert primary anode 60 and the semiconductor wafer 64 as indicated by the arrows 76.

With the electromotive field being direct, the plated metal 78 on the seed layer 66 will be of a uniform thickness which will be easily planarized by subsequent chemical-mechanical planarization processes.

While the invention has been described in conjunction with a specific best mode, it is to be understood that many alternatives, modifications, and variations will be apparent to those skilled in the art in light of the a foregoing description. Accordingly, it is intended to embrace all such alternatives, modifications, and variations which fall within the spirit and scope of the appended claims. All matters hither-to-fore set forth herein or shown in the accompanying drawings are to be interpreted in an illustrative and non-limiting sense.

The invention claimed is:

1. A plating system comprising:

a plating chamber;

a semiconductor wafer connector connectable to connect the semiconductor wafer to a negative voltage source;

an inert primary anode connectable to a positive voltage source;

a consumable shielded secondary anode shielded from the semiconductor wafer connector and connectable to the positive voltage source; and a recirculating system for plating solution.

2. The plating system as claimed in claim 1 wherein the consumable shielded secondary anode is smaller than the inert primary anode.

3. The plating system as claimed in claim 1 wherein the inert primary anode is connectable to the consumable shielded secondary anode.

4. The plating system as claimed in claim 1 wherein the plating chamber is configured to have plating solution cover the inert primary anode and the consumable shielded secondary anode.

5. The plating system as claimed in claim 1 wherein the plating chamber is configured to contain the plating solution.

6. The plating system as claimed in claim 1 including a positive voltage source and a negative voltage source.

7. A plating system comprising:

a plating chamber;

an inert platinum anode connectable to a positive voltage source;

a semiconductor wafer connector connectable to connect the copper seed layer to a negative voltage source;

a consumable copper shielded anode shielded from the semiconductor wafer connector and connectable to the positive voltage source a recirculating system; and including a recirculating pump for plating solution.

8. The plating system as claimed in claim 7 wherein the consumable copper shielded anode is smaller than the inert platinum anode.

9. The plating system as claimed in claim 7 wherein the consumable copper shielded anode is connectable through the inert platinum anode to the positive voltage source.

10. The plating system as claimed in claim 7 including wherein the plating chamber is configured to have a copper ion containing plating solution cover the inert platinum anode and the consumable copper shielded anode.

11. The plating system as claimed in claim 7 including wherein the plating chamber is configured to contain a copper ion plating solution.

12. The plating system as claimed in claim 7 including a positive voltage source and a negative voltage source.

* * * * *